US011857825B2

(12) United States Patent
Koi

(10) Patent No.: US 11,857,825 B2
(45) Date of Patent: Jan. 2, 2024

(54) AUXILIARY WEIGHT TRAINING DEVICE AND METHOD FOR USING SAME

(71) Applicant: PMG Co., Ltd., Toyama (JP)

(72) Inventor: Yoshikazu Koi, Toyama (JP)

(73) Assignee: PMG CO., LTD., Toyama (JP)

( * ) Notice: Subject to any disclaimer, the term of this patent is extended or adjusted under 35 U.S.C. 154(b) by 112 days.

(21) Appl. No.: 17/606,009

(22) PCT Filed: Apr. 23, 2020

(86) PCT No.: PCT/JP2020/017503
§ 371 (c)(1),
(2) Date: Oct. 22, 2021

(87) PCT Pub. No.: WO2020/218423
PCT Pub. Date: Oct. 29, 2020

(65) Prior Publication Data

US 2022/0212051 A1 Jul. 7, 2022

(30) Foreign Application Priority Data

Apr. 25, 2019 (JP) ..... 2019-083614
Apr. 21, 2020 (JP) ..... 2020-075221

(51) Int. Cl.
*A63B 21/062* (2006.01)
*A63B 21/005* (2006.01)
(Continued)

(52) U.S. Cl.
CPC ..... *A63B 21/063* (2015.10); *A63B 21/005* (2013.01); *A63B 24/0087* (2013.01);
(Continued)

(58) Field of Classification Search
CPC . A63B 21/063; A63B 21/005; A63B 21/0724; A63B 21/00058–00069;
(Continued)

(56) References Cited

U.S. PATENT DOCUMENTS 4,890,831 A * 1/1990 Craig ..... A63B 21/0724 482/104
5,236,406 A * 8/1993 Webber ..... A63B 21/4047 482/99
(Continued)

FOREIGN PATENT DOCUMENTS

JP S61226072 10/1986
JP 2005167509 A 6/2005
(Continued)

OTHER PUBLICATIONS

International Search Report in PCT/JP2020/017503, dated Sep. 1, 2020.

*Primary Examiner* — Loan B Jimenez
*Assistant Examiner* — Kathleen M Fisk
(74) *Attorney, Agent, or Firm* — Global IP Counselors, LLP

(57) ABSTRACT

A weight training auxiliary device for adjusting a weight training load of training equipment includes a plurality of weights that generate a load, a load transmission mechanism configured to transmit the load of the weights to the training equipment, and a weight attaching/detaching mechanism configured to attach and detach the weights. At least one of the weights has an electromagnet or a permanent electromagnet built in. The weight attaching/detaching mechanism includes a conduction relay configured to control supply of power to the electromagnet or the permanent electromagnet so that the weight training load is adjusted by attaching or detaching the at least one of the weights.

37 Claims, 10 Drawing Sheets

(51) Int. Cl.
*A63B 71/00* (2006.01)
*A63B 24/00* (2006.01)
*A63B 71/06* (2006.01)

(52) U.S. Cl.
CPC .... *A63B 71/0054* (2013.01); *A63B 2071/068* (2013.01); *A63B 2209/08* (2013.01); *A63B 2220/40* (2013.01); *A63B 2220/808* (2013.01); *A63B 2225/50* (2013.01)

(58) Field of Classification Search
CPC ..... A63B 21/00076; A63B 21/062; A63B 21/0626–0632; A63B 71/0054; A63B 2071/068; A63B 2071/0072; A63B 2209/08; A63B 2220/40; A63B 2220/808; A63B 2220/24; A63B 2220/56; A63B 2220/801; A63B 2225/50; A63B 24/00; A63B 24/0087; A63B 2024/0093
See application file for complete search history.

(56) References Cited

U.S. PATENT DOCUMENTS 6,015,367 A * 1/2000 Scaramucci ..... A63B 21/0628 482/94
6,224,519 B1 * 5/2001 Doolittle ..... A63B 21/063 482/99
6,224,520 B1 * 5/2001 Hsu ..... A63B 21/075 482/107
7,485,076 B2 * 2/2009 Lee ..... A63B 21/00072 482/99
7,507,189 B2 * 3/2009 Krull ..... A63B 21/063 482/99
8,388,499 B1 * 3/2013 Rindfleisch ..... A63B 21/4035 482/8
9,011,301 B2 * 4/2015 Balandis ..... A63B 21/169 482/114
9,498,668 B2 * 11/2016 Smith ..... A63B 21/0628
10,065,076 B2 * 9/2018 Davis ..... A63B 24/0087
10,807,834 B2 * 10/2020 Friessen ..... B66C 1/26
10,905,916 B1 * 2/2021 Malik ..... A61B 5/1128
11,413,490 B1 * 8/2022 Xu ..... A63B 21/0726
2004/0067825 A1 * 4/2004 Daniel ..... A63B 21/0628 482/8
2005/0143228 A1 6/2005 Lee
2013/0303342 A1 * 11/2013 Mandell ..... A63B 21/4001 482/139
2013/0310221 A1 * 11/2013 Zuber ..... G16H 40/60 482/8
2015/0190678 A1 7/2015 Golsby et al.
2016/0199697 A1 * 7/2016 Orfield ..... A63B 24/0062 482/8
2021/0283452 A1 * 9/2021 Chiang ..... A63B 21/0602
2021/0331024 A1 * 10/2021 Kwon ..... A63B 21/0728
2022/0212052 A1 * 7/2022 Ercanbrack ..... A63B 21/0728
2022/0305323 A1 * 9/2022 Larson ..... A63B 21/075

FOREIGN PATENT DOCUMENTS

JP 2005519722 7/2005
JP 2010005350 1/2010

* cited by examiner

RESISTANCE TRAINING DONE IN UNSUPPORTED STATE (BARBELLS)

RESISTANCE TRAINING DONE IN UNSUPPORTED STATE (DUMBBELLS)

AUXILIARY WEIGHT TRAINING DEVICE AND METHOD FOR USING SAME

CROSS-REFERENCE TO RELATED APPLICATIONS

This is a U.S. national phase application of PCT/JP2020/017503, filed on Apr. 23, 2020, which claims priority to Japanese Patent Application No. 2019-083614, filed on Apr. 25, 2019 and Japanese Patent Application No. 2020-075221, filed on Apr. 21, 2020. The entire disclosures of Japanese Patent Application Nos. 2019-083614 and 2020-075221 are hereby incorporated herein by reference.

TECHNICAL FIELD

The present invention relates to a weight training auxiliary device for adjusting a weight training load for muscle building, and the method of use therefor.

BACKGROUND ART

In training for muscle building, such as sports training, it is important to give the required load for effective muscle building at the required time.

However, with conventional weight training equipment, training was only performed using weights with preset weights, and to increase or decrease the load, it was necessary to adjust by manually attaching and detaching the weights, which not only took time and effort, but also made it impossible to respond in real time to the status of the trainee, etc., which fluctuates as the training progresses. In particular, there are not only cases of training with a trainer present, but many cases of doing weight training alone, and in that case, this problem stands out. Here, if using an air type (air resistance type) machine, it is possible to adjust by removing air using a button at hand, but trainees typically place importance on the feel of the weights, so air type machines have not become popular.

To respond to this, attempts have been made to have the exercise continue reasonably to the target, to sense the load, and to adjust the load accordingly to give a sense of achievement. (see Japanese Laid-Open Patent Publication No. 2005-296672)

SUMMARY

However, with the method disclosed in Patent Document 1, the load was applied using a torque motor on a handlebar driven by the motion of the trainee, and if the movement of the training person for moving the handlebar seemed to be stopping, the load would be gradually reduced, so a complex control mechanism was required, and not only was this a problem in terms of cost, but there was also the problem that this could only be applied to handlebar type training machines.

The present invention is a weight training auxiliary device for adjusting a weight training load for muscle building and the method of use therefor, comprising: a plurality of weights that generate a load; a load transmission mechanism that transmits to training equipment a load using the weights; and a mechanism for attaching and detaching the weights, the weight training auxiliary device and the method of use therefor characterized in that part or all of the weights have an electromagnet or a permanent electromagnet built in, the mechanism for attaching and detaching the weights includes a conduction relay that controls the supply of power to the electromagnet or the permanent electromagnet, and the weight training load is adjusted by attaching or detaching a portion of the weights.

The present invention is also characterized in that a part or all of the weights has an electromagnet or a permanent electromagnet built in, the mechanism for attaching and detaching the weights includes a conduction relay that controls the supply of power for weights with the electromagnet or the permanent electromagnet built in, and the weight training load is adjusted by attaching or detaching a portion of the weights.

The present invention is also characterized in that a weight training machine used connected with the weight training auxiliary device is one of a stack type machine, a weight machine, and free weight equipment.

The present invention is also characterized in that the plurality of weights that generate the load are a mixture of weights with an electromagnet or a permanent electromagnet built in, and non-magnetic weights that do not include an electromagnet or a permanent electromagnet.

The present invention is also characterized in that the plurality of weights that generate the load is a mixture of weights with an electromagnet or a permanent electromagnet built in, and non-magnetic weights that do not include an electromagnet or a permanent electromagnet, and the weights with an electromagnet or a permanent electromagnet built in and the weights that do not include an electromagnet or a permanent electromagnet are alternately stacked.

The present invention is also characterized in that the weight training auxiliary device includes a control device, and the control device receives control signals and controls the mechanism for attaching and detaching weights.

The present invention is also characterized in that the control signals input to the control device are signals from a wired switch, a wireless switch, a voice sensor, a sound pressure/sound pitch sensor, an acceleration sensor, a gyro sensor, or a plurality of these.

The present invention is also characterized in that the sensor is a voice sensor or a sound pressure/sound pitch sensor, and the mechanism for attaching and detaching the weights is controlled according to instructions by vocalization of a trainee or a trainer.

The present invention is also characterized in that the sensor is an acceleration sensor, signals from the sensor are analyzed, and the mechanism for attaching and detaching weights is controlled according to a preset program. The present invention is further characterized in that the sensor is an acceleration sensor, the acceleration sensor is installed in weight side equipment of a stack type machine or near the weights of a weight machine, or free weight equipment, the state of the trainee and/or the state of the weight side equipment or the state near the weights is detected, and the mechanism for attaching and detaching the weights is controlled according to a preset program.

The present invention is also characterized in that a gyro sensor is also used together as a sensor.

The present invention is also characterized in that in a stack type machine, a conduction relay that controls the supply of power to weights with a built-in electromagnet or permanent electromagnet of a weight training auxiliary device also serves as a weight stopper pin, and the weight can be set manually by setting the conduction relay and the weight stopper pin.

The present invention is also characterized in that in a weight machine or free weight equipment, a conduction relay that controls the electromagnet or the permanent electromagnet and the power supply is arranged on a collar connected to a shaft of the weight training auxiliary device, and the weight can be set by attaching and detaching the weights attached by the electromagnet or the permanent electromagnet by setting the conduction relay.

The present invention is a weight training auxiliary device comprising a mechanism for adjusting a weight training load for muscle building, in particular, avoiding danger by reducing the load by releasing a portion of the weights in an emergency, comprising a plurality of weights for generating a load, and a mechanism for releasing a portion of the weights in an emergency, characterized in that when the trainee is in a danger state due to an excessive load, danger is avoided by releasing a portion of the weights by an instruction from the trainee or a dispatch from a mechanism that detects the trainee state.

The present invention is also characterized in that a mechanism for emergency release provided in a portion of the weights normally holds weights released in an emergency using an electromagnet or a permanent electromagnet, and a subject weight is released by disabling the magnetic force in an emergency.

The present invention is also characterized in that a mechanism for emergency release provided in a portion of the weights normally holds the weights released in an emergency using a J-shaped holding tool, and the subject weight is released by operating the J-shaped holding tool to make the opening direction downward in an emergency.

The present invention is also characterized in that the weights released in an emergency contain magnetic material. The present invention is also characterized in that the weights released in an emergency contain a soft magnetic material. The present invention is also characterized in that for the weights released in an emergency, iron, silicon steel, permalloy, or an amorphous magnetic alloy is used.

The present invention is also characterized in that for the weights released in an emergency, an item for which a granular material containing iron sand is stored in a bag or a container is used.

The present invention is also characterized in that the weights released in an emergency comprise a holding plate part for normally holding the weights to be released in an emergency using a permanent magnet or an electromagnet, and the holding part is held in contact with a prescribed position of the holding plate by an electromagnet or a permanent electromagnet provided on the training equipment side.

The present invention is also characterized in that the holding plate is formed using a magnetic material. The present invention is also characterized in that the holding plate is formed using a soft magnetic material. The present invention is also characterized in that for the holding plate, iron, silicon steel, permalloy, or an amorphous magnetic alloy is used.

The present invention is also characterized in that the holding plate holds the holding part in contact with a prescribed position of the holding plate by an electromagnet or a permanent electromagnet provided on the training equipment side, and only the part excluding the prescribed position is coated by resin.

The present invention is also characterized in that in the holding plate, the thickness of the magnetic material is 6 mm or greater.

The present invention is also characterized in that the weights released in an emergency are connected to the holding plate, and the main weight part is pillar-shaped.

The present invention is also characterized in that the weights released in an emergency are connected to the holding plate, the main weight part is pillar-shaped, and a part or all is covered by a cushioning material, or a cushioning member can be attached and detached.

The present invention is also characterized in that the mechanism for releasing a portion of the weights in an emergency comprises at least an attachment part that is attached to the shaft of the training machine or the training equipment, a holding part that holds the weights to be released in an emergency, and releases the weights in an emergency, and a control part that receives instructions from the trainee or signals from the mechanism that detects the state of the trainee, and controls the function of the holding part.

The present invention is also characterized in that the attachment part attached to the shaft of the training machine or the training equipment has a hole through which the shaft of the training machine or the training equipment penetrates, the hole has an inner diameter that approximately fits the shaft of the training machine and the training equipment, and is rotatable so that the weights released in an emergency are always positioned below the shaft of the training machine or the training equipment.

The present invention is also characterized in that the structure that is rotatable so that the weights released in an emergency are always positioned below the shaft of the training machine or the training equipment comprises a bearing.

The present invention is also characterized in that the mechanism that releases a portion of the weights in an emergency comprises a power supply.

The present invention is also characterized in that the mechanism that avoids danger by releasing a portion of the weights by an instruction from the trainee or a dispatch from a mechanism that detects the trainee state when the trainee is in a danger state due to an excessive load is activated by detection of vocalization of the trainee, or by sensing changes in the breathing sounds including wheezing.

The present invention is also characterized in that the mechanism that avoids danger by releasing a portion of the weights by an instruction from the trainee or a dispatch from a mechanism that detects the trainee state when the trainee is in a danger state due to an excessive load is activated by activation of a switch attached to or installed near the trainee's arms, legs, fingers, toes, or lips, or by sensing a change with the sensors.

The present invention is also characterized in that in the mechanism that is activated by detection of a vocalization by the trainee or sensing of changes in breathing sounds including wheezing, a microphone is installed near the neck, jaw or lips on the trainee side, and a speech recognition device is provided that judges emergencies from the sounds gathered by the microphone, and when the speech recognition device judges there to be an emergency, a signal is sent to the mechanism that releases a portion of the weights in an emergency.

The present invention is also characterized in that the speech recognition device is a speech recognition device using a sound pressure/sound pitch sensor or a microcomputer. The present invention is also characterized in that communication between the speech recognition device and the mechanism that releases a portion of the weights in an emergency is performed wirelessly.

The present invention realizes a weight training auxiliary device by which the load of weight training equipment can be adjusted easily using a simple structure and the method of use therefor, and thus, it is possible to do repetitive exercise safely to the strength limit point, and possible to obtain the effect of maximum strength enhancement and increased muscle mass.

Also, the present invention realizes a weight training auxiliary device that particularly avoids danger by reducing the load by releasing a portion of the weights in an emergency, and thus, it is possible to do repetitive exercise safely to the strength limit point, and possible to obtain the effect of maximum strength enhancement and increased muscle mass.

DETAILED DESCRIPTION OF EMBODIMENTS

Figure 1:
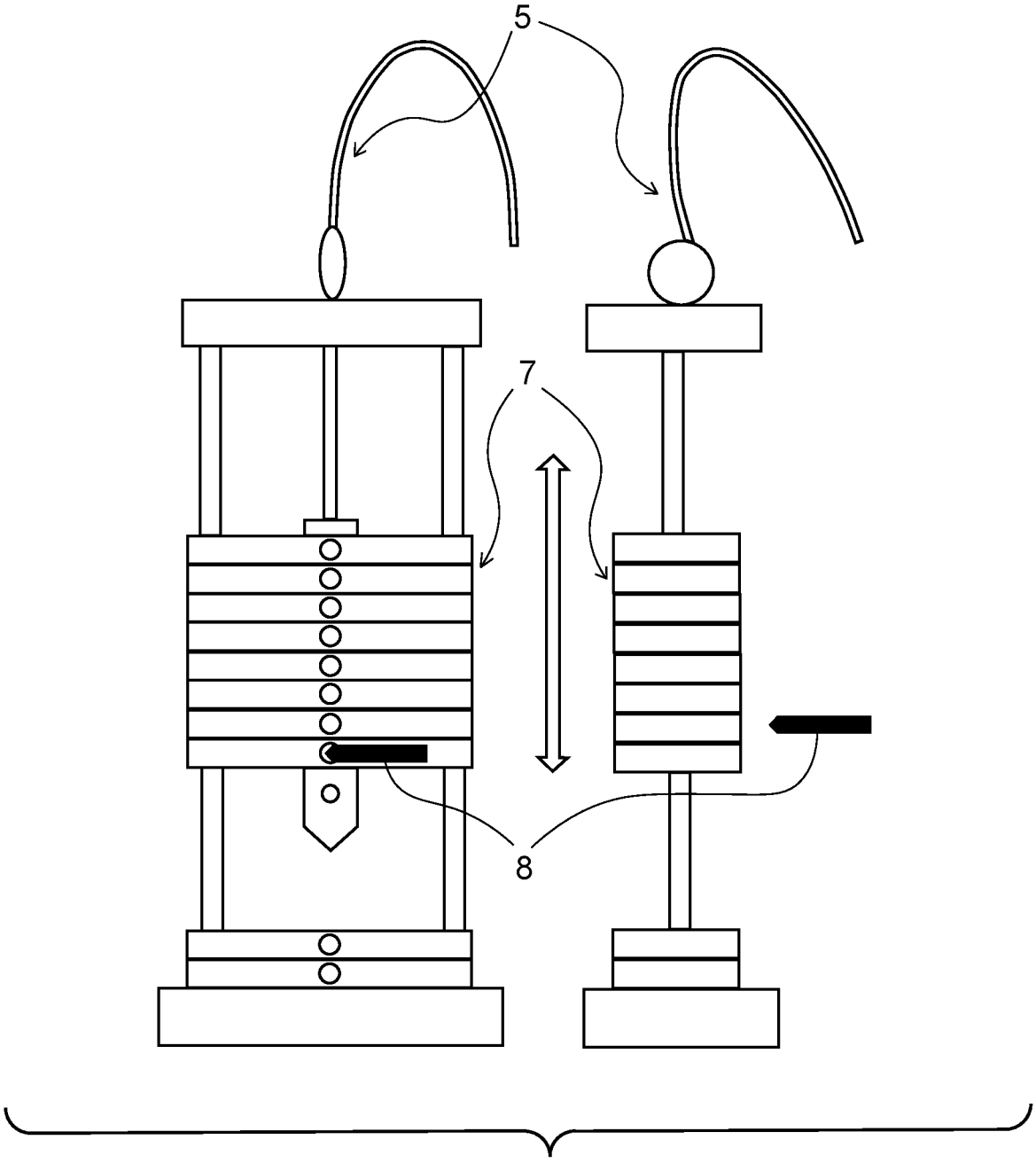
F I G. 1 (PRIOR ART)
FIG. 1 is a schematic diagram showing an example of the configuration of a typical load generating device for stack type training.

The present invention is a weight training auxiliary device for adjusting a weight training load for muscle building and the method of use therefor, comprising: a plurality of weights that generate a load; a load transmission mechanism that transmits to training equipment a load using the weights; and a mechanism for attaching and detaching the weights, the weight training auxiliary device and the method of use therefor characterized in that part or all of the weights have an electromagnet or a permanent electromagnet built in, the mechanism for attaching and detaching the weights includes a conduction relay that controls the supply of power to the electromagnet or the permanent electromagnet, and the weight training load is adjusted by attaching or detaching a portion of the weights.

Using the mechanism of the present invention, it is possible to adjust the weight training load by attaching and detaching a portion of the weights, and possible to easily do effective weight training.

The present invention is also characterized in that a part or all of the weights has an electromagnet or a permanent electromagnet built in, the mechanism for attaching and detaching the weights includes a conduction relay that controls the supply of power for weights with the electromagnet or the permanent electromagnet built in, and the weight training load is adjusted by attaching or detaching a portion of the weights.

The present invention functions in the same manner whether the electromagnet or the permanent electromagnet is adapted. However, when using the permanent electromagnet, when the supply of power is off, the weights are held, and it is possible to release the weights by supplying power to the weight of the necessary site only when necessary, so this also has the advantage of energy saving.

The present invention is also characterized in that a weight training machine used connected with the weight training auxiliary device is one of a stack type machine, a weight machine, and free weight equipment. The method of the present invention can be applied to any of various types of weight training machine and weight training equipment requiring these different configurations.

The present invention is also characterized in that the plurality of weights that generate the load are a mixture of weights with an electromagnet or a permanent electromagnet built in, and non-magnetic weights that do not include an electromagnet or a permanent electromagnet. This makes it possible to increase the number of weights that can be attached and detached in a single action, and enabling efficient use. It is also possible to use a material with cushioning properties in non-magnetic weights, which is effective in reducing impact and sound when they drop.

The present invention is also characterized in that the plurality of weights that generate the load is a mixture of weights with an electromagnet or a permanent electromagnet built in, and non-magnetic weights that do not include an electromagnet or a permanent electromagnet, and the weights with an electromagnet or a permanent electromagnet built in and the weights that do not include an electromagnet or a permanent electromagnet are alternately stacked. This similarly makes it possible to increase the number of weights that can be attached and detached in a single action, and enabling efficient use. Furthermore, with a free weight machine or free weights, if several auxiliary devices are attached to the shaft, and the response level of each auxiliary device is changed, even more efficient use is possible.

The present invention is also characterized in that the weight training auxiliary device includes a control device, and the control device receives control signals and controls the mechanism for attaching and detaching weights.

The present invention is also characterized in that the control signals input to the control device are signals from a wired switch, a wireless switch, a voice sensor, a sound pressure/sound pitch sensor, an acceleration sensor, a gyro sensor, or a plurality of these.

The present invention is also characterized in that the sensor is a voice sensor or a sound pressure/sound pitch sensor, and the mechanism for attaching and detaching the weights is controlled according to instructions by vocalization of a trainee or a trainer. This makes is possible to adjust the load according to the required instructions without interrupting training, making it possible to easily do effective weight training.

The present invention is also characterized in that the sensor is an acceleration sensor, signals from the sensor are analyzed, and the mechanism for attaching and detaching weights is controlled according to a preset program. The present invention is further characterized in that the sensor is an acceleration sensor, the acceleration sensor is installed in weight side equipment of a stack type machine, or near the weights of a weight machine, or free weight equipment, the state of the trainee and/or the state of the weight side equipment or the state near the weights is detected, and the mechanism for attaching and detaching the weights is controlled according to a preset program.

The present invention is also characterized in that a gyro sensor is also used together as a sensor. Control that utilizes these sensor information makes even more efficient load adjustment possible, so it is possible to do easy and effective weight training, and this is also effective in terms of ensuring safety.

The present invention is also characterized in that in a stack type machine, a conduction relay that controls the supply of power to weights with a built-in electromagnet or permanent electromagnet of a weight training auxiliary device also serves as a weight stopper pin, and the weight can be set manually by setting the conduction relay and the weight stopper pin. In the case of this manual method, it is possible to use the same configuration as is.

The present invention is also characterized in that in weight machines or free weight equipment, a conduction relay that controls the electromagnet or the permanent electromagnet and the power supply is arranged on a collar connected to a shaft of the weight training auxiliary device, and the weight can be set by attaching and detaching the weights attached by the electromagnet or the permanent electromagnet by setting the conduction relay. In general, adjusting the weights in real time is very difficult in weight machines or free weight equipment, but this is realized by the configuration of the present invention. It is also possible to efficiently adjust the load in weight machines or free weight equipment, making it possible to do easy effective weight training, and this is also effective in terms of ensuring safety.

The present invention is a weight training auxiliary device comprising a mechanism for adjusting a weight training load for muscle building, in particular, avoiding danger by reducing the load by releasing a portion of the weights in an emergency, comprising a plurality of weights for generating a load, and a mechanism for releasing a portion of the weights in an emergency, characterized in that when the trainee is in a danger state due to an excessive load, danger is avoided by releasing a portion of the weights by an instruction from the trainee or a dispatch from a mechanism that detects the trainee state. Especially when doing in-depth training, it is necessary to do training at the load weight limit of the trainee, but in that case, when the limit is exceeded during training, there is the risk of dropping the training equipment and causing damage to the equipment, or if dropped on the trainee's body, this can lead to injury, or in the worst case even death. The present invention is effective in reducing these risks.

The present invention is also characterized in that a mechanism for emergency release provided in a portion of the weights normally holds weights released in an emergency using an electromagnet or a permanent electromagnet, and a subject weight is released by disabling the magnetic force in an emergency. This makes reliable and immediate release possible.

The present invention is also characterized in that a mechanism for emergency release provided in a portion of the weights normally holds the weights released in an emergency using a J-shaped holding tool, and the subject weight is released by operating the J-shaped holding tool to make the opening direction downward in an emergency.

The present invention is also characterized in that the weights released in an emergency contain magnetic material. The present invention is also characterized in that the weights released in an emergency contain a soft magnetic material. The present invention is also characterized in that for the weights released in an emergency, iron, silicon steel, permalloy, or an amorphous magnetic alloy is used. This makes it possible to operate by particularly controlling magnetic force.

The present invention is also characterized in that for the weights released in an emergency, an item for which a granular material containing iron sand is stored in a bag or a container is used.

The present invention is also characterized in that the weights released in an emergency comprise a holding plate part for normally holding the weights to be released in an emergency using an electromagnet or a permanent electromagnet, and the holding part is held in contact with a prescribed position of the holding plate by a permanent magnet or an electromagnet provided on the training equipment side.

The present invention is also characterized in that the holding plate is formed using a magnetic material. The present invention is also characterized in that the holding plate is formed using a soft magnetic material. The present invention is also characterized in that for the holding plate, iron, silicon steel, permalloy, or an amorphous magnetic alloy is used.

The present invention is also characterized in that the holding plate holds the holding part in contact with a prescribed position of the holding plate by an electromagnet or a permanent electromagnet provided on the training equipment side, and only the part excluding the prescribed position is coated by resin. This makes it possible to accurately define the mounting position, which is effective for reliable operation.

The present invention is also characterized in that in the holding plate, the thickness of the magnetic material is 6 mm or greater. As a result, holding with sufficient magnetic force is realized.

The present invention is also characterized in that the weights released in an emergency are connected to the holding plate, and the main weight part is pillar-shaped.

The present invention is also characterized in that the weights released in an emergency are connected to the holding plate, the main weight part is pillar-shaped, and a part or all is covered by a cushioning material, or a cushioning member can be attached and detached. This increases safety when dropped, and is also effective for equipment maintenance.

The present invention is also characterized in that the mechanism for releasing a portion of the weights in an emergency comprises at least an attachment part that is attached to the shaft of the training machine or the training equipment, a holding part that holds the weights to be released in an emergency, and releases the weights in an emergency, and a control part that receives instructions from the trainee or signals from the mechanism that detects the state of the trainee, and controls the function of the holding part.

The present invention is also characterized in that the attachment part attached to the shaft of the training machine or the training equipment has a hole through which the shaft of the training machine or the training equipment penetrates, the hole has an inner diameter that approximately fits the shaft of the training machine and the training equipment, and is rotatable so that the weights released in an emergency are always positioned below the shaft of the training machine or the training equipment.

The present invention is also characterized in that the structure that is rotatable so that the weights released in an emergency are always positioned below the shaft of the training machine or the training equipment comprises a bearing. As a result, the weights are not biased during training, and can be reliably dropped during emergency dropping.

The present invention is also characterized in that the mechanism that releases a portion of the weights in an emergency comprises a power supply.

The present invention is also characterized in that the mechanism that avoids danger by releasing a portion of the weights by an instruction from the trainee or a dispatch from a mechanism that detects the trainee state when the trainee is in a danger state due to an excessive load is activated by detection of vocalization of the trainee, or by sensing changes in the breathing sounds including wheezing. As a result, it is possible to disconnect the load not only in a case when the trainee gives an active instruction to disconnect, but also in a state when vocalization is difficult, and this contributes to improved safety.

The present invention is also characterized in that the mechanism that avoids danger by releasing a portion of the weights by an instruction from the trainee or a dispatch from a mechanism that detects the trainee state when the trainee is in a danger state due to an excessive load is activated by activation of a switch attached to or installed near the trainee's arms, legs, fingers, toes, or lips, or by sensing a change with the sensors. With this configuration, it is possible to give accurate instructions even in the case of a trainee with a disability, for example.

The present invention is also characterized in that in the mechanism that is activated by detection of a vocalization by the trainee or sensing of changes in breathing sounds including wheezing, a microphone is installed near the neck, jaw or lips on the trainee side, and a speech recognition device is provided that judges emergencies from the sounds gathered by the microphone, and when the speech recognition device judges there to be an emergency, a signal is sent to the mechanism that releases a portion of the weights in an emergency.

The present invention is also characterized in that the speech recognition device is a speech recognition device using a sound pressure/sound pitch sensor or a microcomputer. The present invention is also characterized in that communication between the speech recognition device and the mechanism that releases a portion of the weights in an emergency is performed wirelessly. As a result, the weight training auxiliary device is realized that particularly avoids danger by reducing the load by releasing a portion of the weights in an emergency, and thus, it is possible to do repetitive exercise safely to the strength limit point, and possible to obtain the effect of maximum strength enhancement and increased muscle mass.

Embodiment 1

Following, a weight training auxiliary device of the present invention and the method of use therefor are explained using the drawings. FIG. 1 is a schematic diagram showing an example of the configuration of a typical load generating device for stack type training. A normal weight plate 7 is set using a weight stopper pin 8, and transmission to a training machine or equipment is done via a load transmission mechanism 5. In this way, training is normally performed only using a preset load, and when adjusting the load, the stopper pin had to be removed and inserted to adjust the number of weight plates.

Figure 2:
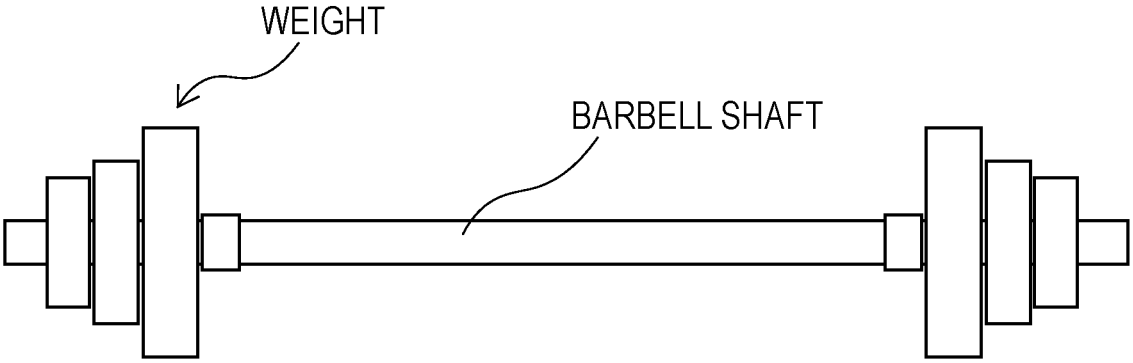
F I G. 2 (PRIOR ART)
FIG. 2 is a schematic diagram showing an example of typical free weight equipment.
Figure 2:
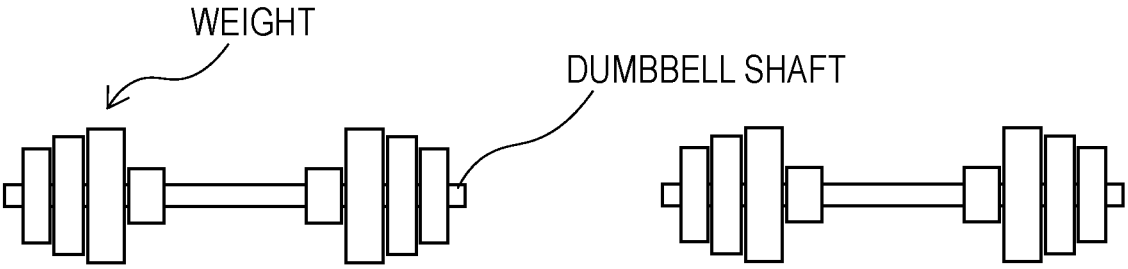
F I G. 2 (PRIOR ART)

FIG. 2 is a schematic diagram showing an example of typical free weight equipment. Similarly in this case as well, in resistance training done in an unsupported state (barbells, dumbbells, etc.), training is performed using a preset load using weights. In this drawing, in addition to a main weight, provided are sub weights that can be attached and detached, but this attachment and detachment must similarly be done manually in advance.

Figure 3:
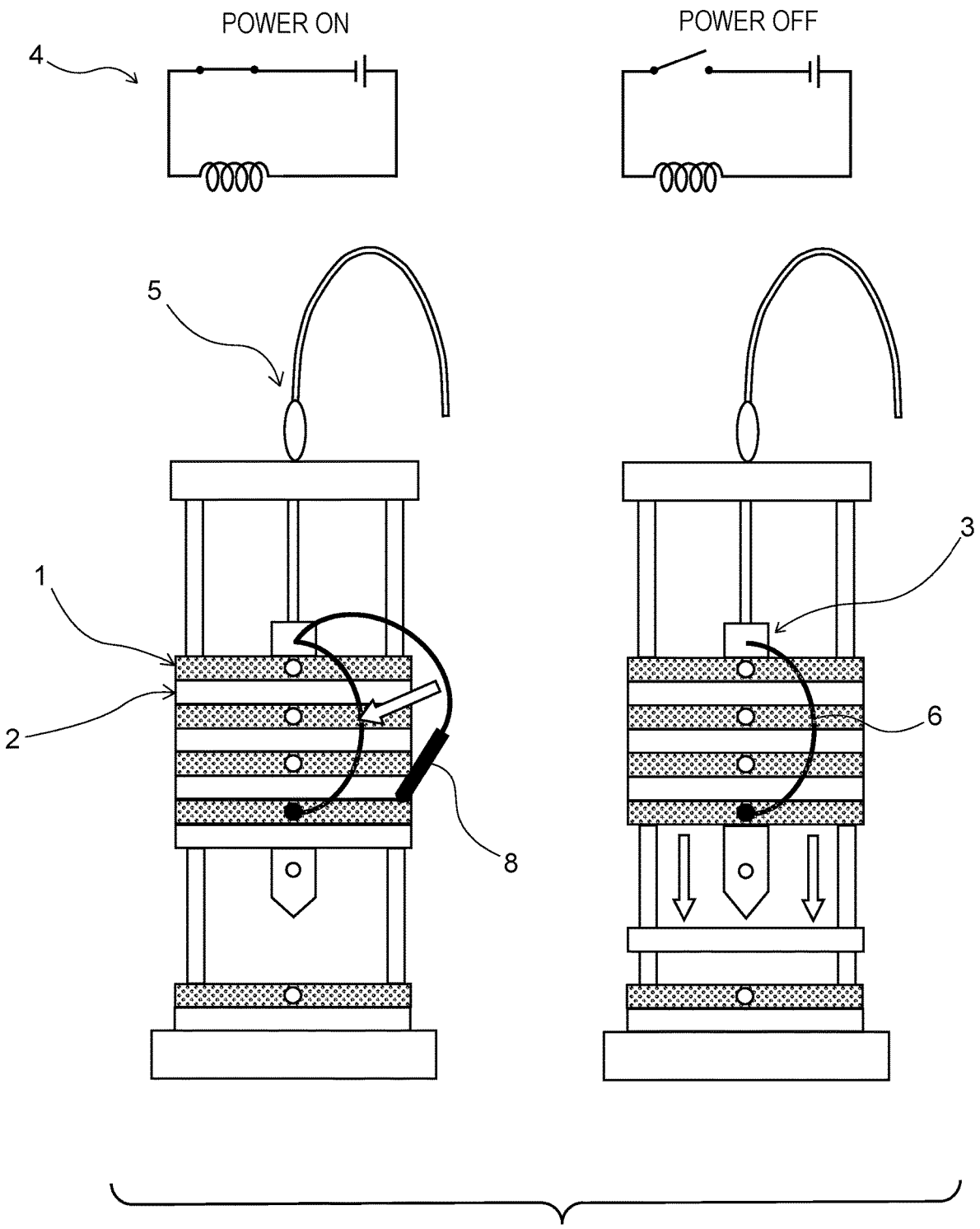
FIG. 3 is a schematic diagram showing an example of the configuration of a stack type training machine of a load generating device for training of the present invention.

In contrast to this, with the weight training auxiliary device of the present invention and the method of use therefor, realized is a weight training auxiliary device and the method of use therefor that makes it possible to adjust the load of the weight training equipment easily using a simple configuration, and thus, it is possible to safely do repetitive exercise to the strength limit point, and possible to obtain the effect of maximum strength enhancement and increased muscle mass. FIG. 3 is a schematic diagram showing an example of the configuration of a stack type training machine of a load generating device for training of the present invention. Here, as shown in the left side of the drawing, while electricity is flowed to the electromagnet inside the main weight plate fixed by a stopper pin to the desired number of weight plates, the weight plates for dropping are in a state attached by magnetic force. The weight plates for dropping are in a state like floating in the air, and as shown in the right side of the drawing, if the power supply is turned off and the magnetic force is gone, they drop down. With free machines and free weight types, the weights for dropping attached to the electromagnet included with the collar auxiliary device drop down if the power supply is turned off and there is no magnetic force. Turning on and off of the power supply can be done with wires or wirelessly using a switch or sensor. Here, in this embodiment, the configuration uses an electromagnet, and operation is also explained using this case, but it is also possible to configure the present invention using a permanent electromagnet, and in this case, though the on and off operation of the power supply is reversed, the same action can be obtained.

Figure 4:
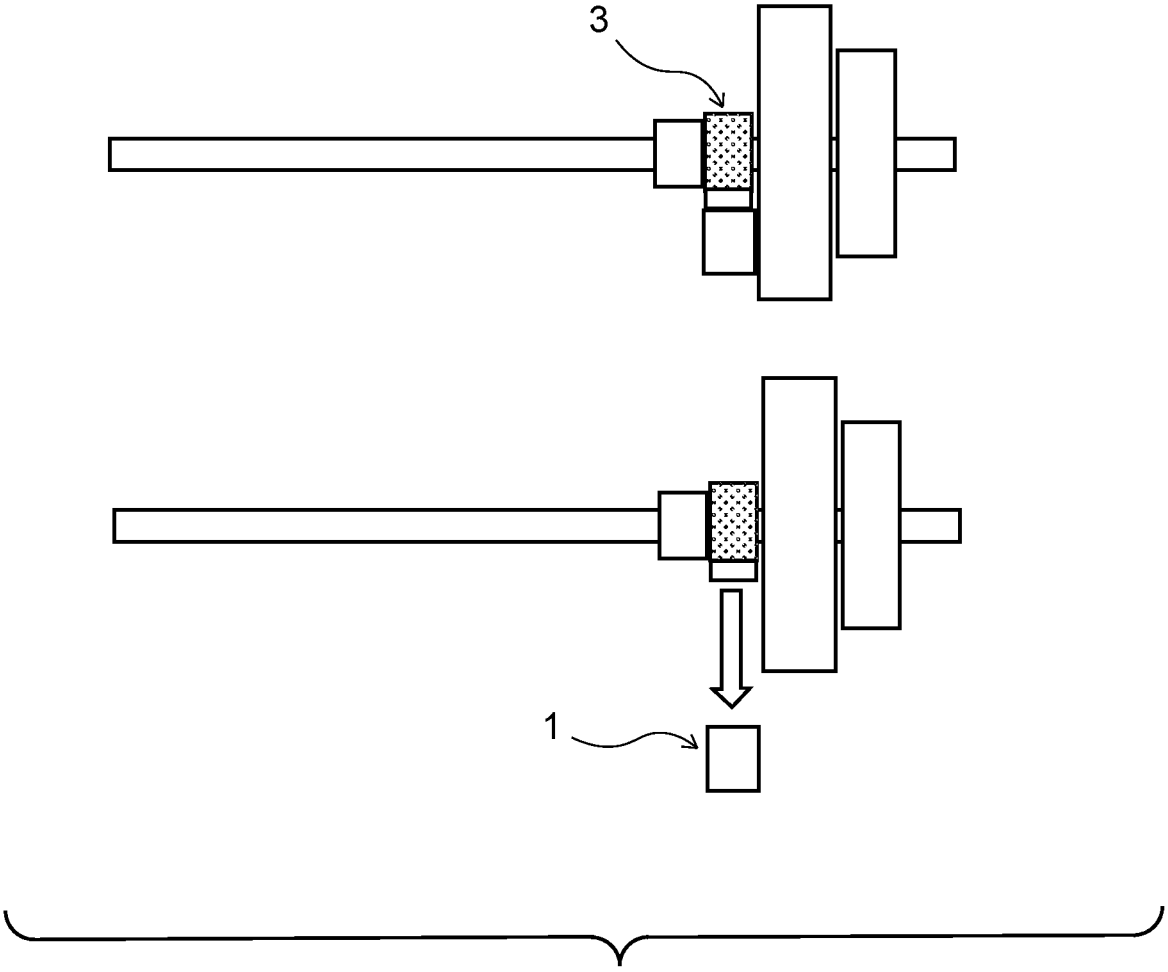
FIG. 4 is a schematic diagram showing an example of a configuration in which the load generating device for training of the present invention is used for free weight equipment.

FIG. 4 is a schematic diagram showing an example of a configuration in which the load generating device for training of the present invention is used for free weight equipment. With free machines and free weight types, the weights for dropping that are attached to the electromagnet included with the collar auxiliary device drop down if the power supply is turned off and there is no magnetic force. Turning on and off of the power supply can be done with a wire or wirelessly using a switch or sensor. In this way, in free weight equipment as well, it is possible to exhibit the same function if using the mechanism of the present invention on sub weights. Here, in this embodiment, the configuration uses an electromagnet, and operation is also explained using this case, but the present invention can also be a configuration using a permanent electromagnet, and in this case, though the on and off operation of the power supply is reversed, the same action can be obtained.

Figure 5:
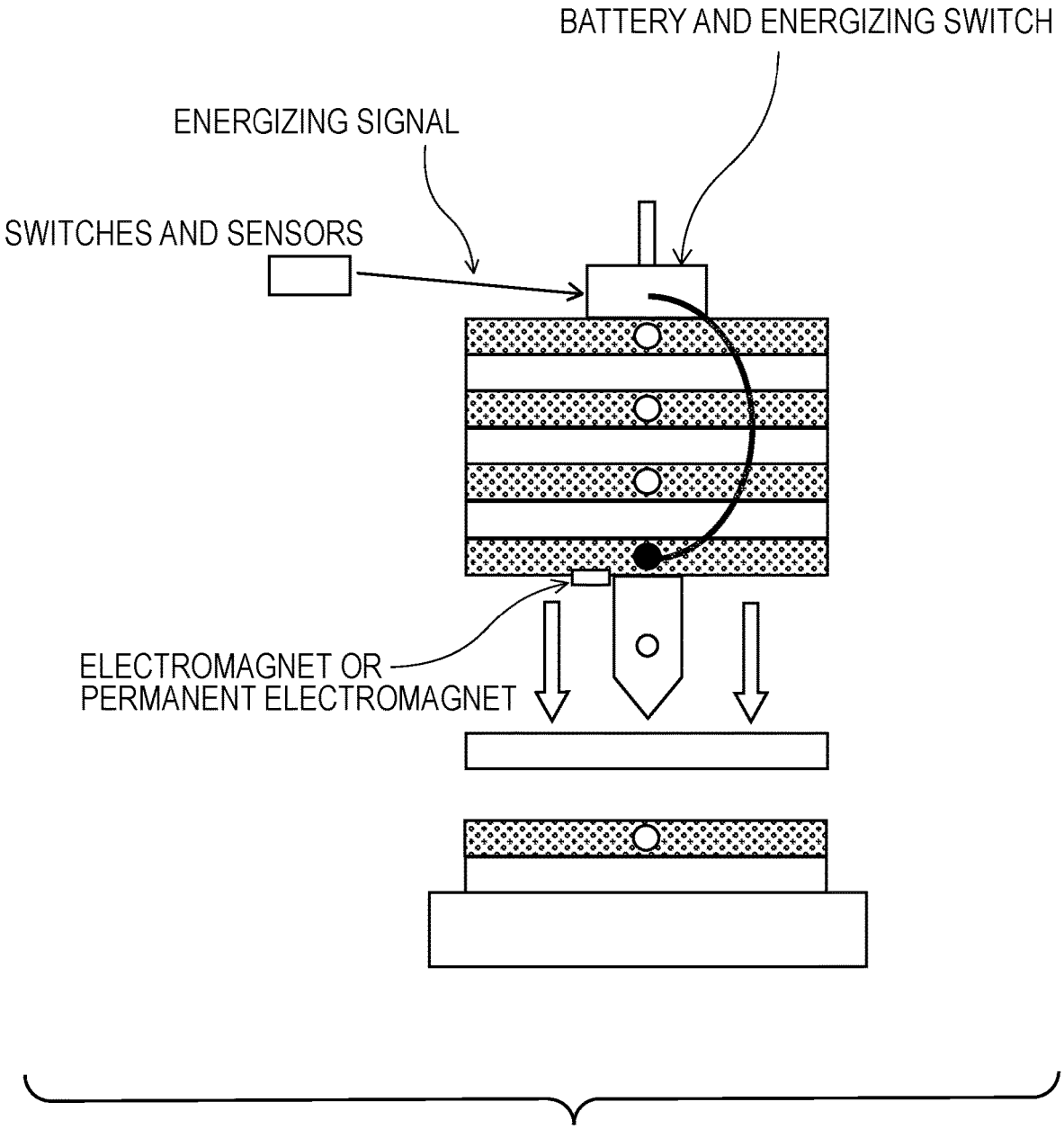
FIG. 5 is a schematic diagram showing an example of a configuration of a stack type training machine of the load generating device for training of the present invention, and is an example of a configuration combined with a voice sensor.

FIG. 5 is a schematic diagram showing an example of a configuration of a stack type training machine of the load generating device for training of the present invention, and is an example of a configuration combined with a voice sensor. Using the voice recognition sensor, whether wired or wirelessly, it is possible to drop the weights by turning on and off the current in response to vocalization by a trainee or a trainer, and possible to adjust the load in real time.

Figure 6:
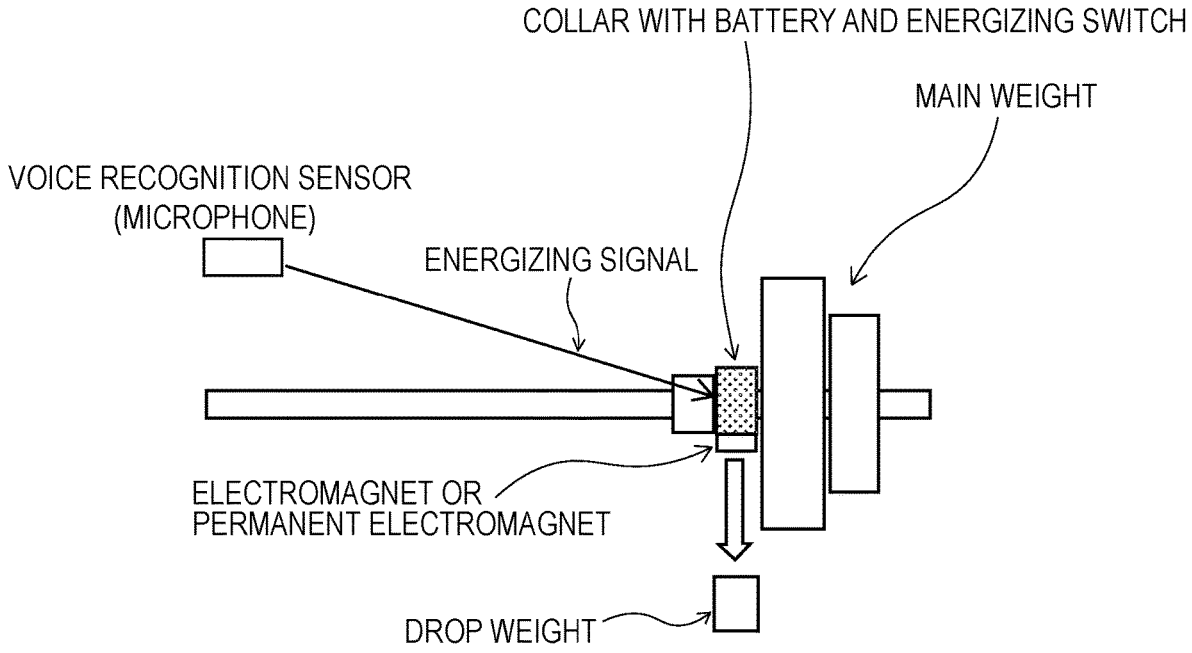
FIG. 6 is a schematic diagram showing an example of a configuration in which the load generating device for training of the present invention is used for free weight equipment, and is an example of a configuration combined with a voice sensor.

FIG. 6 is a schematic diagram showing an example of a configuration in which the load generating device for training of the present invention is used for free weight equipment, and is an example of a configuration combined with a voice sensor. In this embodiment as well, it is possible to adjust the load in real time with free weight equipment.

Figure 7:
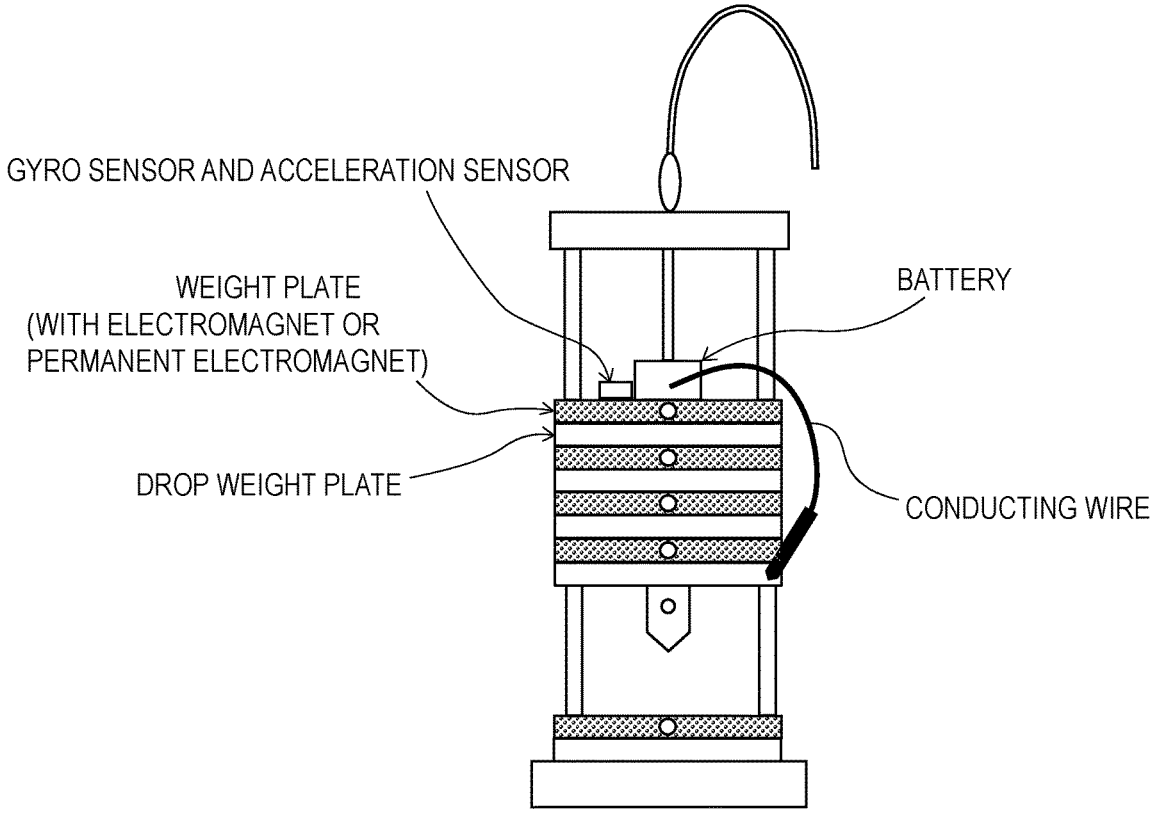
FIG. 7 is a schematic diagram showing an example of a configuration of the load generating device for training of the present invention, and is an example of a configuration combined with an acceleration sensor.

FIG. 7 is a schematic diagram showing an example of a configuration of the load generating device for training of the present invention, and is an example of a configuration combined with an acceleration sensor. In a stack type or weight machine type, by attaching an acceleration sensor, there is recognition when there is insufficient power for training movements where the speed of the weight rise is extremely slow or the range of motion is not reached, and by turning the power supply on or off, weight plates are dropped to resolve the insufficient power, making more in-depth training possible, and making it possible to ensure safety.

Figure 8:
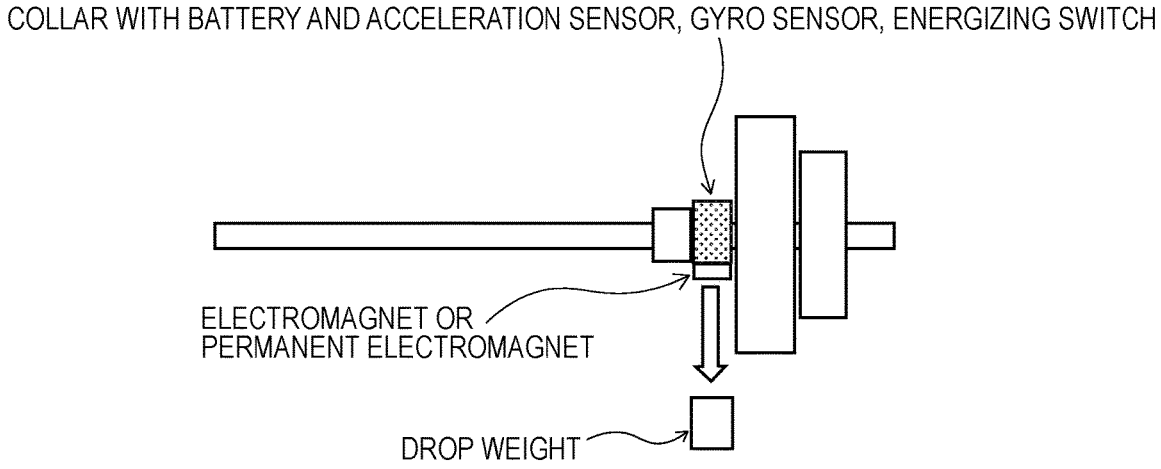
FIG. 8 is a schematic diagram showing an example of a configuration in which the load generating device for training of the present invention is used for free weight equipment, and is an example of a configuration combined with an acceleration sensor and/or a gyro sensor.

FIG. 8 is a schematic diagram showing an example of a configuration in which the load generating device for training of the present invention is used for free weight equipment, and is an example of a configuration combined with an acceleration sensor and/or a gyro sensor. In the free weight type, it is possible to obtain the same operation as noted above by attaching the acceleration sensor and the gyro sensor.

The abovementioned acceleration sensor can be roughly divided for measuring three phenomena of "weight," "vibration and movement," and "impact." By successfully detecting each phenomenon, the output signals of the acceleration sensor can be useful for actual applications.

First, the working of the acceleration sensor or the gyro sensor in an automatic method of a stack type machine and/or a weight machine auxiliary device is explained. With the abovementioned training method, when a weight is lifted, upward acceleration works, and a change in the acceleration occurs. That change is sensed, and when the acceleration of the weight is zero or in a range close to zero for a fixed period, there is judged to be insufficient power, and otherwise it is judged to be appropriate. A change in the acceleration also occurs regarding the operation of lowering the weight, but since power is eased for the downward operation, there is basically no need to assist with the weight, and it is not necessary to detect a change in acceleration. In light of that, the up and down direction is judged with the gyro sensor, and by ascertaining the maximum reciprocal range of motion of the weight using the acceleration sensor, a judgment is made of whether the current state is in the outward path or the return path, and when in the return path (during downward operation), even if the acceleration is zero or in a range near zero, this is not judged to be insufficient power. With this judgment, management of turning on and off the conduction is performed (specifically, load adjusting).

Here, the maximum range of motion judgment for a stack type machine, weight machine, and/or free weight type automatic auxiliary device is described. With a stack type machine and/or a weight machine, initially, the maximum range (distance) that weights can operate on that machine is set, and by judging the position of the weight with the acceleration sensor, a judgment is made of whether the start point, turnaround point, and end point of the reciprocal movement range of motion are appropriate. In the free weight type automatic auxiliary device, the maximum range of each individual first is set first, and judgment and setting of the appropriate reciprocal movement range of motion are performed.

Next, the working of the acceleration sensor of the automatic method in the free weight type auxiliary device is explained. The abovementioned principles can basically be appropriated for the automatic method of the free weight type as well, but there is no set track such as a rail as there is with the stack type machine or the weight machine, and the movement may become irregular, so a gyro sensor is used to detect and respond to various types of operations. This makes it possible to do appropriate load adjusting in real time with free weight type equipment as well. Here, the maximum range of motion judgment is as described above. Use of the gyro sensor is not limited to the free weight type auxiliary device, and can also be utilized to improve the accuracy of movement analysis and load adjustment for the stack type machines and/or weight machine auxiliary devices as well.

Embodiment 2

Figure 9:
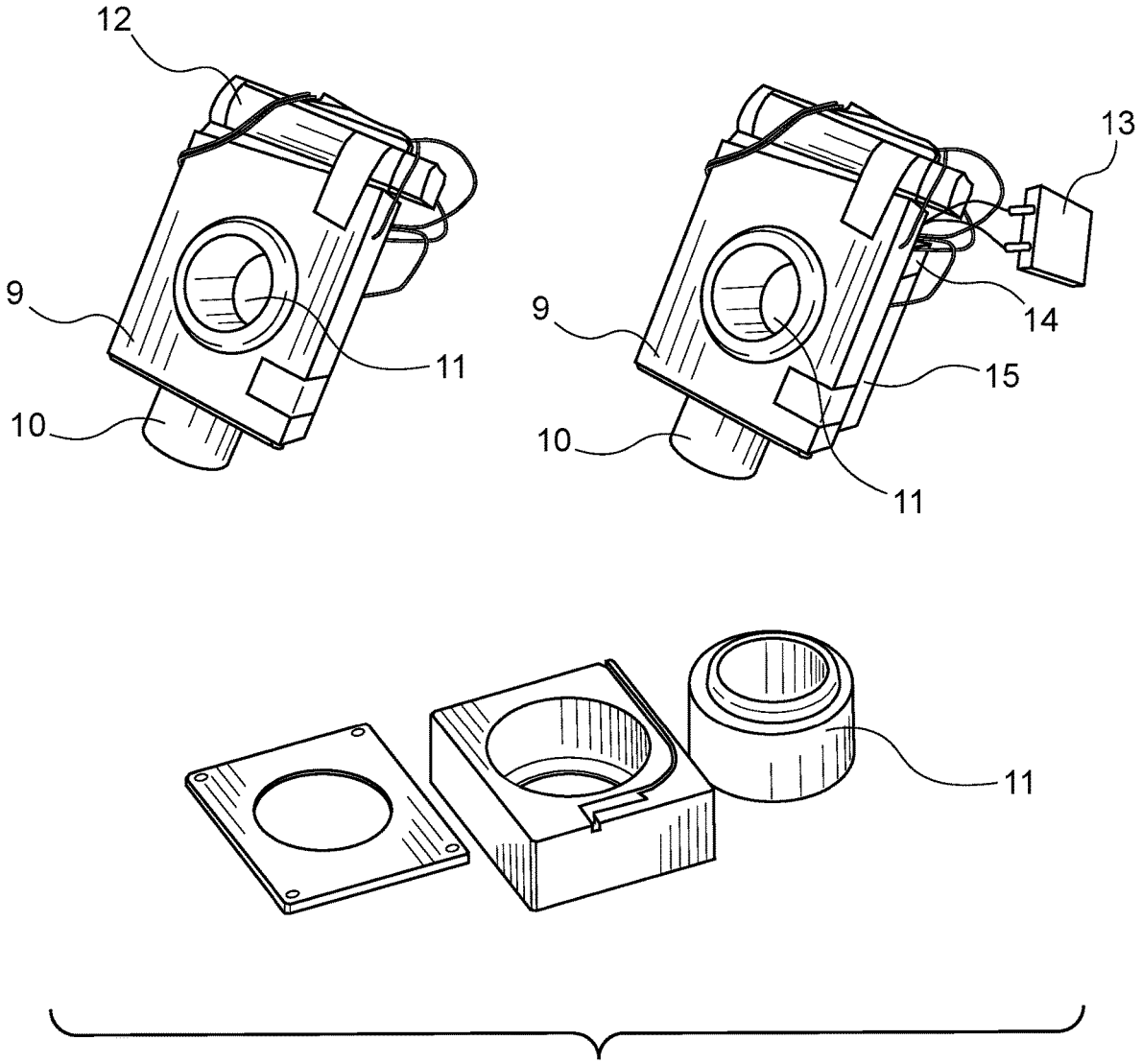
FIG. 9 is a drawing showing an example of an embodiment of the weight training auxiliary device of the present invention, particularly of an auxiliary device collar for free weights (training machine side attachment device) used in a configuration to avoid danger by reducing the load by releasing a portion of the weights in an emergency.

FIG. 9 is a drawing showing an example of an embodiment of the weight training auxiliary device of the present invention, particularly of an auxiliary device collar for free weights (training machine side attachment device) used in a configuration to avoid danger by reducing the load by releasing a portion of the weights in an emergency. With this embodiment, this device is installed together with the main weight on the barbell shaft for free weight training, and detachable weights are held and used in this device.

With this embodiment, a mode was used in which the weights are held using magnetic force. The configuration is such that weights to be released in an emergency are normally held by a permanent magnet or an electromagnet, and subject weights are released by disabling the magnetic force in an emergency. Of course, it is also acceptable to use a configuration in which the weights to be released in an emergency are normally held by a J shaped holding tool, and to have the subject weights released by operating the J shaped holding tool so the opening direction is downward in an emergency.

In an auxiliary device collar body for free weights 9, a weight holding unit (magnetic force holding unit: electromagnet or permanent electromagnet) 10 is provided, and this is where the load weight is normally held by magnetic force. There is a hole 11 on the body through which the shaft of the training machine penetrates, and this is where the shaft of the barbell for free weight training penetrates. Here, the hole has an inner diameter approximately fitted with the shaft of the training machine, and by comprising a bearing, the configuration is such that the weight to be released in an emergency can rotate to always be in a lower position than the shaft of the training machine.

A receiving module 12 is provided on the auxiliary device collar body for free weights 9, and signals are received from the trainee side device making it possible to execute the necessary operation. Also comprised are a battery 13, an activation switch 14, and a booster 15.

Figure 10:
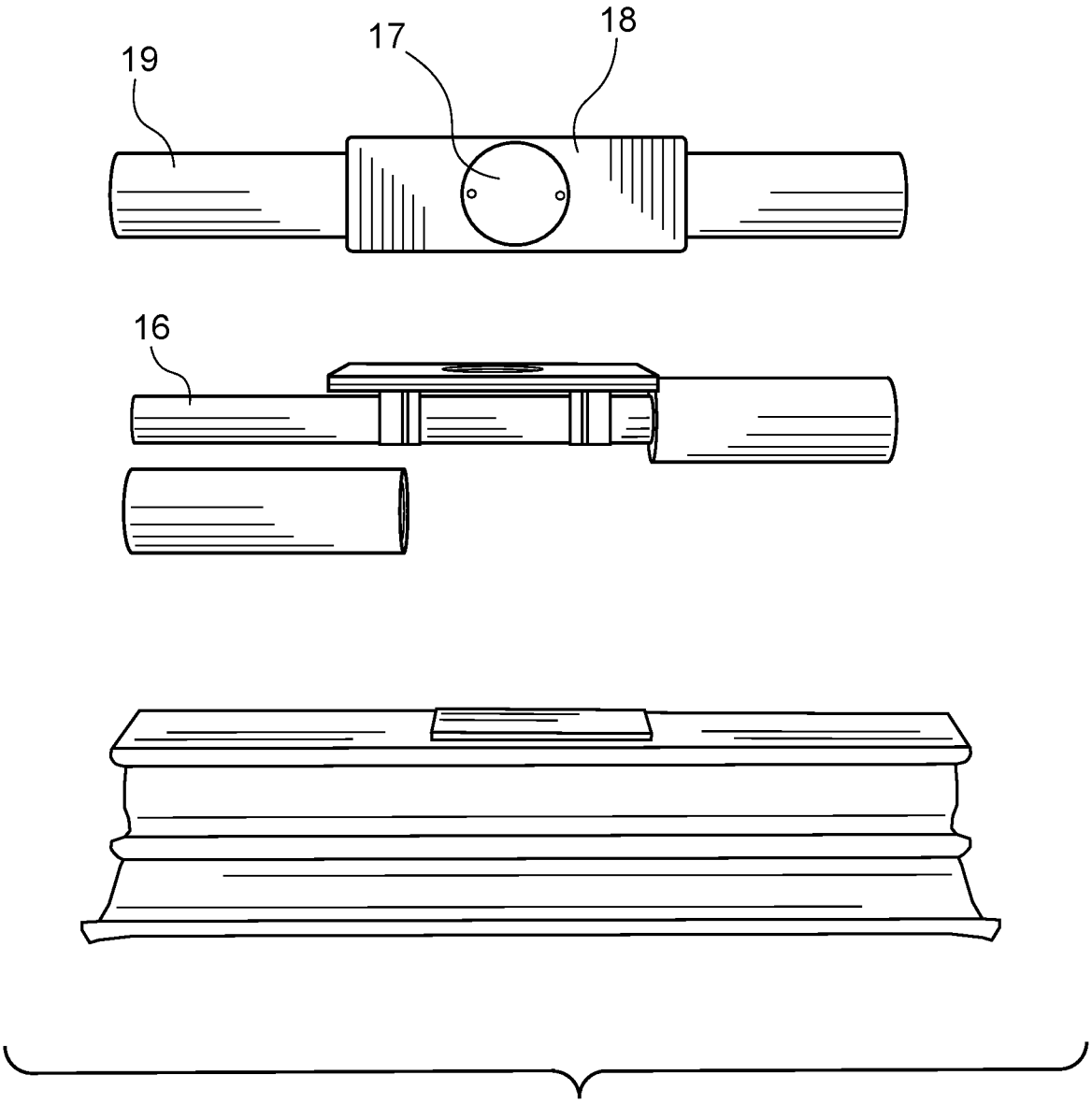
FIG. 10 is a drawing showing an example of an embodiment of a weight for free weights (weight) according to the weight training auxiliary device of the present invention.

FIG. 10 is a drawing showing an example of an embodiment of a weight for free weights (weight) according to the weight training auxiliary device of the present invention. The upper two images show examples of weights formed using an iron pole, and the lower image shows an embodiment of a case when granular material containing iron sand stored in a bag is used as the weight. Of the upper two images showing embodiments in which the weight is formed by an iron pole, the upper image shows the mode from the planar direction, and the lower image from the front direction. With this embodiment, a weight body 16 is formed using an iron pole, and a holding plate 17 is connected to this.

An iron plate of 6 mm thickness is used for the holding plate 17, and other than the holding unit is a resin coating part 18. A cushioning material grip 19 is detachably installed on the weight body 16.

Figure 11:
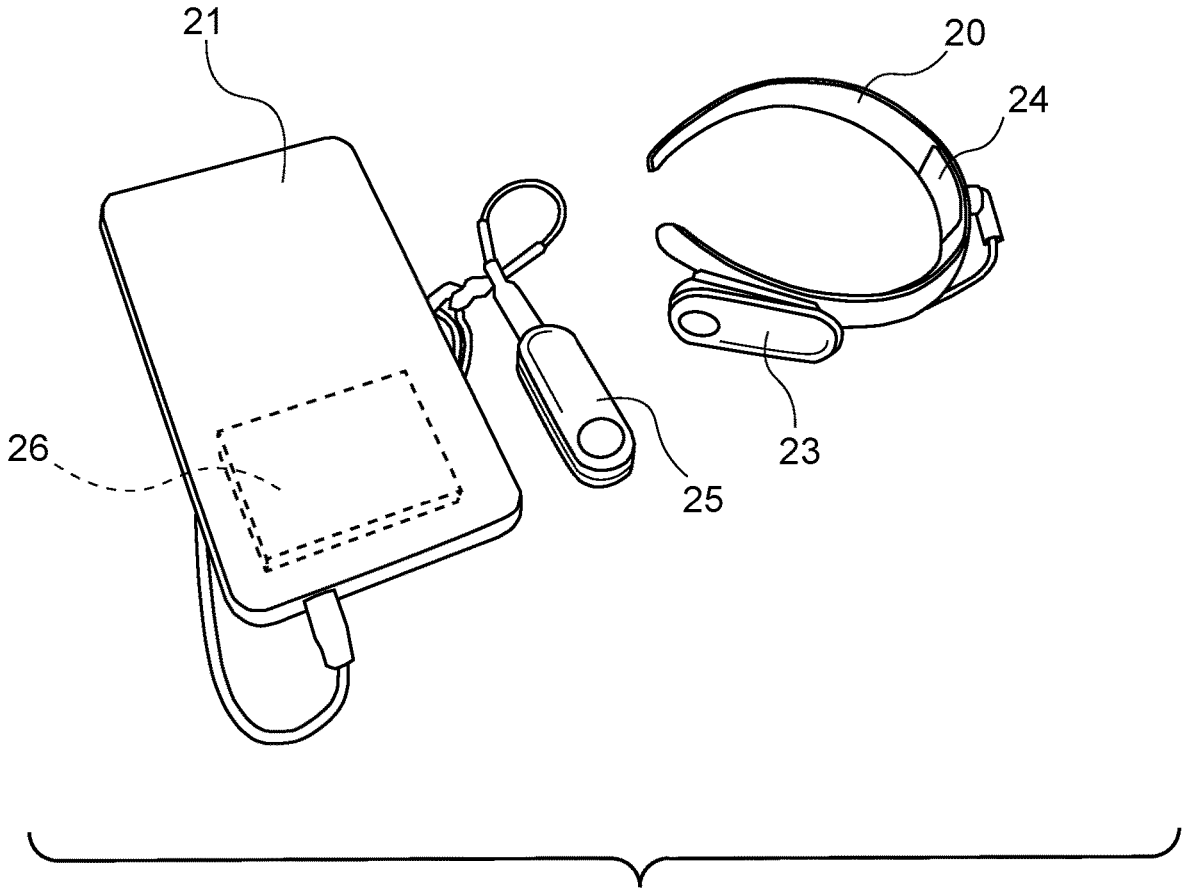
FIG. 11 is a drawing showing an example of an embodiment of trainee side equipment according to the weight training auxiliary device of the present invention.

FIG. 11 is a drawing showing an example of an embodiment of trainee side equipment according to the weight training auxiliary device of the present invention. With this embodiment, equipment 20 worn on the trainee's body and a voice recognition transmitter 18 are separate bodies, and the connection between these is wireless. Here, of course it is also acceptable to connect these using a wire.

With this embodiment, the equipment 20 worn on the body is made to be worn on the neck of the trainee, and the voice is detected using a microphone 22. In a case when the trainee is in a danger state due to an excessive load, a signal is generated by a voice recognition signal transmitter 21 by detection of trainee vocalization or by sensing a change in breathing sounds including wheezing, this is transmitted to the auxiliary device collar body for free weights, and releasing of the load weights is executed. An audio signal transmitter 23 and a dirt prevention tape 24 are provided on the equipment 20 worn on the body. An audio signal receiver 25 is provided on the side of the voice recognition signal transmitter 21, the audio signal from the microphone 22 of the equipment 20 worn on the body is received by the audio signal receiver 25 from the audio signal transmitter 23, a judgment is made by a sound pressure/sound pitch sensor 26, and a signal is transmitted to the auxiliary device collar body for free weights 9.

As a result, weight training that is safe with good efficiency is made possible by realizing the weight training auxiliary device that avoids danger by reducing the load by releasing a portion of the weights in an emergency. Here, the present invention is not limited to the modes of the embodiment, and for example it is also acceptable to have a configuration in which activation is done of a switch attached to or installed near the trainee's arms, legs, fingers, toes, or lips, or activation is done by sensing changes by the sensors, and also acceptable for devices to be linked using a wired connection.

INDUSTRIAL APPLICABILITY

The weight training auxiliary device and the method of use therefor of the present invention realizes a weight training auxiliary device and the method of use therefor in which it is possible to adjust the load of weight training equipment easily using a simple configuration, and thus, it is possible to do repetitive exercise safely to the strength limit point, and possible to obtain a maximum strength enhancement and increased muscle mass effect, which can be said to have great potential for industrial applicability.

Also, the weight training auxiliary device of the present invention realizes the weight training auxiliary device that particularly avoids danger by reducing the load by releasing a portion of the weights in an emergency, and thus, it is possible to do repetitive exercise safely to the strength limit point, and possible to obtain a maximum strength enhancement and increased muscle mass effect, which can be said to have great potential for industrial applicability.

EXPLANATION OF CODES

1 Weight plate with built-in electromagnet or permanent electromagnet
2 Non-magnetic weight plate
3 Control device
4 Conduction relay
5 Load transmission mechanism
6 Conducting wire
7 Normal weight plate
8 Weight stopper pin
9 Auxiliary device collar for free weights
10 Weight holding unit (magnetic force holding unit: electromagnet or permanent electromagnet)
11 Hole through which shaft of training machine penetrates
12 Receiving and energizing module
13 Battery
14 Activation switch
15 Booster
16 Weight body (iron pole)
17 Holding plate
18 Resin coating part
19 Cushioning material grip
20 Equipment worn on trainee's body
21 Voice recognition signal transmitter
22 Microphone
23 Audio signal transmitter
24 Dirt prevention tape
25 Audio signal receiver
26 Sound pressure/sound pitch relay

The invention claimed is:

1. A weight training auxiliary device comprising:

a plurality of weights for generating a load; and an emergency weight releasing mechanism configured to release a portion of the plurality of weights in an emergency based on an instruction from a trainee or a signal representing a trainee state when the trainee is in a danger state due to an excessive load, wherein the emergency weight releasing mechanism includes at least:

an attachment part that is attached to a shaft of a training machine or training equipment, a holding part that holds the portion of the plurality of weights in a normal state, and releases the portion the plurality of weights in the emergency, a control part configured to receive the instruction from the trainee or the signal representing the trainee state, and to control an operation of the holding part, the attachment part defines a hole through which the shaft of the training machine or the training equipment penetrates, the hole has an inner diameter that approximately fits the shaft of the training machine or the training equipment, and the attachment part is rotatable so that the portion of the plurality of weights released in the emergency is always positioned below the shaft of the training machine or the training equipment.

2. The weight training auxiliary device according to claim 1, further comprising a holding plate that is configured to be attached to the holding part of the emergency weight releasing mechanism using an electromagnet or a permanent magnet in the normal state.

3. The weight training auxiliary device according to claim 2, wherein the holding plate is formed using a magnetic material.

4. The weight training auxiliary device according to claim 3, wherein the holding plate is formed using a soft magnetic material.

5. The weight training auxiliary device according to claim 4, wherein the holding plate is made of iron, silicon steel, permalloy, or an amorphous magnetic alloy.

6. The weight training auxiliary device according to claim 3, wherein a thickness of the magnetic material is 6 mm or greater.

7. The weight training auxiliary device according to claim 2, wherein the portion of the plurality weights released in the emergency are connected to the holding plate, and a main weight part of each of the plurality of weights is pillar-shaped.

8. The weight training auxiliary device according to claim 7, wherein a part or all of the portion of the plurality of weights released in the emergency is covered by a cushioning material or a detachable cushioning member.

9. The weight training auxiliary device according to claim 2, wherein the holding plate is coated by resin except for a prescribed position where the holding plate contacts the holding part in the normal state.

10. The weight training auxiliary device according to claim 1, wherein the portion of the plurality of weights to be released in the emergency contains magnetic material.

11. The weight training auxiliary device according to claim 10, wherein the portion of the plurality of weights to be released in the emergency contains a soft magnetic material.

12. The weight training auxiliary device according to claim 11, wherein the portion of the plurality of weights to be released are made of iron, silicon steel, permalloy, or an amorphous magnetic alloy.

13. The weight training auxiliary device according to claim 11, wherein each weight of the portion of the plurality of weights comprises a bag or container storing iron sand.

14. The weight training auxiliary device according to claim 1, wherein in the normal state, the emergency weight releasing mechanism is configured to hold the portion of the plurality of weights to be released in the emergency using an electromagnet or a permanent electromagnet, and in the emergency, the emergency weight releasing mechanism is configured to release the portion of the plurality of weights by disabling a magnetic force of the electromagnet or the permanent electromagnet.

15. The weight training auxiliary device according to claim 1, wherein the attachment part comprises a bearing allowing for rotation of the attachment part.

16. The weight training auxiliary device according to claim 1, wherein the emergency weight releasing mechanism includes a power supply.

17. The weight training auxiliary device according to claim 1, wherein the emergency weight releasing mechanism is activated by activation of a switch or a change detected by a sensor, the switch or the sensor being configured to be attached to or installed near the trainee's arms, legs, fingers, toes, or lips.

18. A weight training auxiliary device for adjusting a weight training load of training equipment, comprising:

a plurality of weights that generate a load; and a weight attaching/detaching mechanism configured to attach and detach the plurality of weights, wherein the plurality of weights include two or more magnetic weights each having an electromagnet or a permanent electromagnet built therein and two or more non-magnetic weights that do not include an electromagnet or a permanent electromagnet, the weight attaching/detaching mechanism includes a conduction relay configured to control supply of power to the electromagnet or the permanent electromagnet of each of the two or more magnetic weights so that the weight training load is adjusted by attaching or detaching at least one of the two or more magnetic weights, and the two or more magnetic weights and the two or more non-magnetic weights are alternately stacked.

19. The weight training auxiliary device according to claim 18, further comprising a control device configured to receive control signals and control the weight attaching/detaching mechanism.

20. The weight training auxiliary device according to claim 19, wherein the control device is configured to receive signals from at least one of a wired switch, a wireless switch, a voice sensor, a sound pressure/sound pitch sensor, an acceleration sensor, and a gyro sensor, as the control signals.

21. The weight training auxiliary device according to claim 20, wherein the control device is configured to receive the signals from the voice sensor or the sound pressure/sound pitch sensor, and the control device is configured to control the weight attaching/detaching mechanism according to instructions by vocalization or pronunciation of a trainee or a trainer.

22. The weight training auxiliary device according to claim 21, wherein the control device is further configured to receive signals from the gyro sensor.

23. The weight training auxiliary device according to claim 20, wherein the control device is configured to receive the signals from the acceleration sensor, and the control device is configured to analyze the signals from the acceleration sensor, and control the weight attaching/detaching mechanism according to a preset program.

24. The weight training auxiliary device according to claim 23, wherein the training equipment is a stack type machine, the acceleration sensor is installed in weight side equipment of the stack type machine, the control device is configured to detect a state of a trainee and/or a state of the weight side equipment, and the control device is configured to control the weight attaching/detaching mechanism according to the preset program.

25. A method for using a weight training auxiliary device for adjusting a weight training load of training equipment, the weight training auxiliary device comprising:

a plurality of weights to generate a load; and a weight attaching/detaching mechanism for attaching and detaching the plurality of weights, wherein the plurality of weights include two or more magnetic weights each having an electromagnet or a permanent electromagnet built therein and two or more non-magnetic weights that do not include an electromagnet or a permanent electromagnet, the weight attaching/detaching mechanism includes a conduction relay configured to control supply of power to the electromagnet or the permanent electromagnet of each of the two or more magnetic weights, and the two or more magnetic weights and the two or more non-magnetic weights are alternately stacked;

the method comprising:

performing weight training by adjusting the weight training load by attaching and detaching at least one of the two or more magnetic weights by controlling the supply of power to the electromagnet or the permanent electromagnet of the at least one of the two or more magnetic weights.

26. The method for using the weight training auxiliary device according to claim 25, further comprising a control device configured to receive control signals and control the weight attaching/detaching mechanism.

27. The method for using the weight training auxiliary device according to claim 26, wherein the control device is configured to receive signals from at least one of a wired switch, a wireless switch, a voice sensor, a sound pressure/sound pitch sensor, an acceleration sensor, and a gyro sensor, as the control signals.

28. The method for using the weight training auxiliary device according to claim 27, wherein the control device is configured to receive the signals from the voice sensor or the sound pressure/sound pitch sensor, and the control device is configured to control the weight attaching/detaching mechanism according to instructions by vocalization or pronunciation of a trainee or a trainer.

29. The method for using the weight training auxiliary device according to claim 28, wherein the control device is further configured to receive signals from the gyro sensor.

30. The method for using the weight training auxiliary device according to claim 27, wherein the control device is configured to receive the signals from the acceleration sensor, and the control device is configured to analyze the signals from the acceleration sensor, and control the weight attaching/detaching mechanism according to a preset program.

31. The method for using the weight training auxiliary device according to claim 30, wherein the training equipment is a stack type machine, the acceleration sensor is installed in weight side equipment of the stack type machine, the control device is configured to detect a state of a trainee and/or a state of the weight side equipment, and the control device is configured to control the weight attaching/detaching mechanism according to the preset program.

32. A weight training auxiliary device comprising:

a plurality of weights for generating a load;

an emergency weight releasing mechanism comprising an electromagnet or a permanent electromagnet configured to release a portion of the plurality of weights in an emergency based on an instruction from a trainee or a signal from a mechanism that detects a trainee state when the trainee is in a danger state due to an excessive load, the mechanism that detects the trainee state comprising:

a microphone configured to be installed near a neck, jaw or lips of the trainee, and a speech recognition device that judges emergencies from sounds gathered by the microphone, wherein the emergency weight releasing mechanism is activated by disabling a magnetic force holding the portion of the plurality of weights by detection of vocalization of the trainee, or by sensing changes in breathing sounds, when the speech recognition device judges there to be an emergency, the signal is sent to the emergency weight releasing mechanism, and the speech recognition device uses a sound pressure/sound pitch sensor or a microcomputer.

33. The weight training auxiliary device according to claim 32, wherein communication between the speech recognition device and the emergency weight releasing mechanism is performed wirelessly.

34. A weight training auxiliary device for adjusting a weight training load of training equipment, comprising:

a plurality of weights that generate a load; and a weight attaching/detaching mechanism configured to attach and detach the plurality of weights, wherein at least one of the plurality of weights has an electromagnet or a permanent electromagnet built therein, the weight attaching/detaching mechanism includes a conduction relay configured to control supply of power to the electromagnet or the permanent electromagnet of the at least one of the plurality of weights so that the weight training load is adjusted by attaching or detaching the at least one of the plurality of weights, the conduction relay is electrically connected to a weight stopper pin in a stack type machine as the training equipment, so that the plurality of weights are configured to be set manually by inserting the weight stopper pin into one of the plurality of weights of the stack type machine.

35. A weight training auxiliary device for adjusting a weight training load of training equipment, comprising:

a plurality of weights that generate a load; and a weight attaching/detaching mechanism configured to attach and detach the plurality of weights, wherein at least one of the plurality of weights has an electromagnet or a permanent electromagnet built therein, the weight attaching/detaching mechanism includes a conduction relay configured to control supply of power to the electromagnet or the permanent electromagnet of the at least one of the plurality of weights so that the weight training load is adjusted by attaching or detaching the at least one of the plurality of weights, the conduction relay is arranged on a collar connected to a shaft of a weight machine or free weight equipment as the training equipment to which the weight training auxiliary device is coupled so that the plurality of weights are configured to be set by attaching and detaching the at least one of the plurality of weights with the electromagnet or the permanent electromagnet by powering on and off the conduction relay.

36. A method for using a weight training auxiliary device for adjusting a weight training load of training equipment, the weight training auxiliary device comprising:

a plurality of weights to generate a load; and a weight attaching/detaching mechanism for attaching and detaching the plurality of weights, wherein at least one of the plurality of weights has an electromagnet or a permanent electromagnet built therein, the weight attaching/detaching mechanism includes a conduction relay configured to control supply of power to the electromagnet or the permanent electromagnet of the at least one of the plurality of weights, the method comprising:

performing weight training by adjusting the weight training load by attaching and detaching the at least one of the plurality of weights by controlling the supply of power to the electromagnet or the permanent electromagnet of the at least one of the plurality of weights, wherein the conduction relay is electrically connected to a weight stopper pin in a stack type machine as the training equipment, so that the plurality of weights are configured to be set manually by inserting the weight stopper pin in one of the plurality of weights of the stack type machine.

37. A method for using a weight training auxiliary device for adjusting a weight training load of training equipment, the weight training auxiliary device comprising:

a plurality of weights to generate a load; and a weight attaching/detaching mechanism for attaching and detaching the plurality of weights, wherein at least one of the plurality of weights has an electromagnet or a permanent electromagnet built in the weight attaching/detaching mechanism includes a conduction relay configured to control supply of power to the electromagnet or the permanent electromagnet of the at least one of the plurality of weights, the method comprising:

performing weight training by adjusting the weight training load by attaching and detaching the at least one of the plurality of weights by controlling the supply of power to the electromagnet or the permanent electromagnet of the at least one of the plurality of weights, wherein the conduction relay is arranged on a collar connected to a shaft of a weight machine or free weight equipment as the training equipment to which the weight training auxiliary device is coupled so that the plurality of weights are configured to be set by attaching and detaching the at least one of the plurality of weights with the electromagnet or the permanent electromagnet by powering on or off the conduction relay.

* * * * *